US007334466B1

(12) United States Patent
Brislin

(10) Patent No.: US 7,334,466 B1
(45) Date of Patent: Feb. 26, 2008

(54) METHOD AND APPARATUS FOR PREDICTING AND EVALUATING PROJECTILE PERFORMANCE

(75) Inventor: Philip Brislin, Budd Lake, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 284 days.

(21) Appl. No.: 11/306,605

(22) Filed: Jan. 4, 2006

Related U.S. Application Data

(60) Provisional application No. 60/593,282, filed on Jan. 4, 2005.

(51) Int. Cl.
*G01L 5/14* (2006.01)

(52) U.S. Cl. ..... 73/167

(58) Field of Classification Search ..... 73/167
See application file for complete search history.

(56) References Cited

U.S. PATENT DOCUMENTS 197,398 A * 11/1877 O'Neil ..... 73/167
3,766,778 A * 10/1973 Henrichsen ..... 73/167
3,932,748 A * 1/1976 Schmitz ..... 376/159
4,464,975 A * 8/1984 Terry et al. ..... 89/41.13
4,901,361 A * 2/1990 Glenn et al. ..... 382/100
5,205,168 A * 4/1993 Cattin et al. ..... 73/167
5,817,969 A * 10/1998 Ettmuller ..... 102/489

FOREIGN PATENT DOCUMENTS

WO WO 3006915 A1 * 1/2003

* cited by examiner

*Primary Examiner*—Hezron Williams
*Assistant Examiner*—John Fitzgerald
(74) *Attorney, Agent, or Firm*—John F. Moran

(57) ABSTRACT

Apparatus and accompanying methods to evaluate the performance of an antipersonnel/canister projectile using either test data or theoretical data. It provides a three dimensional projection of the fragments/payload that can be evaluated using a variety of performance criteria. The method can be applied to numerous target types and shapes. This method can also be adjusted to evaluate antipersonnel projectiles that utilize a fuze dispersion (payload is dispersed with an explosive charge).

16 Claims, 6 Drawing Sheets

METHOD AND APPARATUS FOR PREDICTING AND EVALUATING PROJECTILE PERFORMANCE

CROSS REFERENCE TO RELATED APPLICATION

This application claims the benefit under 35 USC 119(e) of U.S. Provisional Patent Application No. 60/522,201 filed Jan. 4, 2005, the entire file wrapper contents of which are herein incorporated by reference as though set forth at length.

UNITED STATES GOVERNMENT INTEREST

The inventions described herein may be manufactured, used and licensed by or for the U.S. Government for U.S. Government purposes.

FEDERAL RESEARCH STATEMENT

The invention described herein may be made, used, licensed by or for the United States Government for government purposes without payment of any royalties thereon or therefore.

FIELD OF THE INVENTION

The present invention relates generally to the prediction and/or evaluation of the effectiveness of antipersonnel or canister projectiles or the like under different conditions.

BACKGROUND OF THE INVENTION

Antipersonnel/Canister cartridges have been produced for 105 mm caliber and a number of gun calibers since cannons came into use. The basic principle is the expulsion of a large number of lethal sub-projectiles, fragments, flechettes, balls or other objects. The various sub-projectiles are accelerated during gun launch or during a detonation of an explosive charge to achieve a lethal velocity or the kinetic energy needed to accomplish suppression of troops, targets, or material obstacles. A distinction is typically made between "antipersonnel" cartridges, which implement an explosive fuze for payload dispersion, and "canister" cartridges, whose payloads spread via mechanical, aerodynamic, or inertial forces.

The dispersed payload needs to be evaluated in some manner to determine projectile performance. Various methods have been employed over the years in which actual projectiles were applied against full size targets, cloths, plywood, etc. Symmetrical patterns have been described using cone angles and basic measures of density. Statistical descriptions have also been used depending on the dispersion pattern type.

A typical target that is used in making such evaluations is a 10-man squad arranged in a "V" formation. A plan view of such a target 100 is shown in FIG. 1A. Typical distances 101 and 102 between adjacent squad members 110.N are 5 m each. FIG. 1B is an elevation view of an exemplary profile or silhouette for each squad member 110.N.

It is desirable to be able to evaluate the lethality of a canister projectile with varying pattern densities, multiple sub-projectile sizes, and pattern asymmetries.

A canister projectile has recently been developed for the 120 mm gun system. The pattern is currently being evaluated by describing the impacts on the target (such as that of FIGS. 1A and 1B) using a statistical curve fit from collected test data. This projectile design is amenable to a statistical curve fit approach because the pattern produced is of a uniform sub-projectile size, is symmetric, and has a single density distribution. The statistical curve fit is then utilized to determine the average number of impacts on a target at a given range. The average number of impacts on a target is then compared to incapacitation criteria to determine projectile performance.

Several problems arise, however, when using a statistical curve fit to describe the performance of a projectile having a particular dispersion pattern. The number of hits on each target silhouette is determined as a function of range based on the distribution fit to the data. As a result, the average number of hits is often a non-integer value with fractions of a hit (i.e. 2.4, 4.3, 5.6). In real life, however, it is not possible for a target silhouette to be hit with fractions of a sub-projectile. This makes it difficult to determine whether predetermined incapacitation criteria have been met where the model predicts a non-integer number of hits. Thus, for example, if a minimum of two hits is required for incapacitation, 1.99 hits could be deemed sufficient or insufficient depending on the degree of rounding-off involved.

An additional difficulty that arises is whether or not the pattern can be sufficiently described by a statistical curve fit. This often proves to be difficult especially if any asymmetries exist, multiple sub-projectile sizes are used, or varying density distributions are present.

In addition to the inherent difficulties in accurately describing patterns with statistical curve fits, the costs of conventional tests can also be significant. The 120 mm canister requires large cloth targets at various ranges to collect target data. This can lead to very expensive test setup costs due to the large size of the patterns and extensive ranges to be evaluated. The time associated with target setup and data collection is also quite costly. In some cases targets have grown to over 100' long at certain ranges, and they only capture a portion of the pattern. Plywood silhouette targets are also currently used in conjunction with cloth targets for further validation, further complicating conventional test procedures.

SUMMARY OF THE INVENTION

In an exemplary embodiment, the present invention provides a method and system that uses test data or theoretical data to efficiently predict and evaluate the performance of antipersonnel or canister projectiles over a wide range of conditions. The method and system provide a three-dimensional dispersion pattern of the payload that can be evaluated using a variety of performance criteria. The present invention can be readily applied to numerous target types and shapes and can be used to evaluate antipersonnel projectiles that utilize a fuze dispersion (payload is dispersed with an explosive charge) as well as canister projectiles.

While the present invention can account for asymmetries in the payload dispersion patterns, varying payload (e.g., ball) sizes, and varying density distributions, it can also be used for simple symmetric dispersion patterns as well.

These and other aspects of the present invention are described more fully below.

BRIEF DESCRIPTION OF THE DRAWINGS

Various features and advantages of the present invention and the manner of attaining them will be described in greater detail with reference to the following description, claims and drawings wherein:

DETAILED DESCRIPTION

Figure 2B:
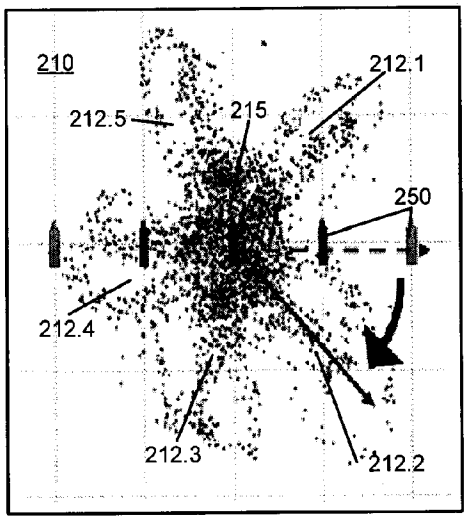
FIGS. 2A and 2B show elevation views of two orientations of an exemplary sub-projectile dispersion pattern.
Figure 2A:
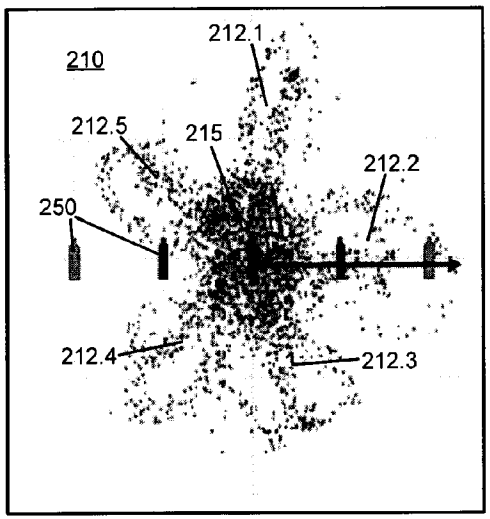
Figure 2C:
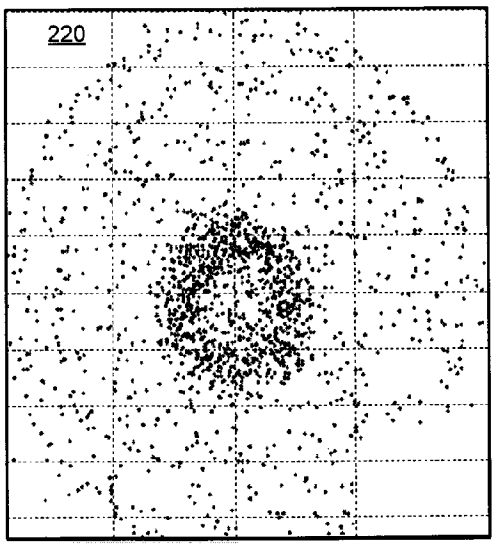
FIG. 2C shows an elevation view of a second exemplary sub-projectile dispersion pattern.

FIGS. 2A-2C are elevation views of examples of sub-projectile dispersion patterns 210, 220 generated from the test-firing of canister projectiles. The patterns of FIGS. 2A-2C depict the dispersion of a projectile's payload over a given area at some distance from the point of separation of the payload. The payload includes sub-projectiles such as balls or fragments, which may be uniform in size or of two or more different sizes.

Figure 1B:
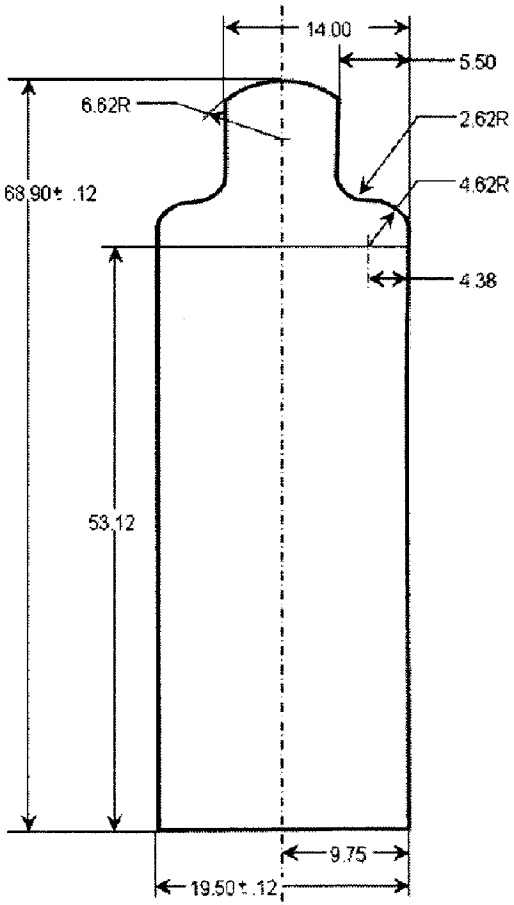
FIG. 1B shows an elevation view of an exemplary profile of an individual squad member.
Figure 1A:
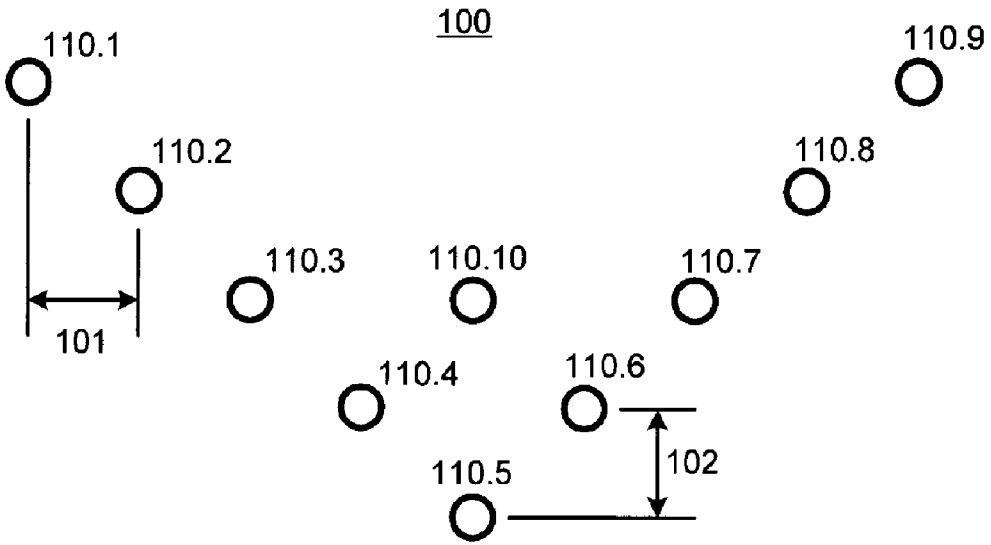
FIG. 1A shows a plan view of a 10-man squad arranged in a "V" formation typically used as a target for evaluating the effectiveness of antipersonnel projectiles.

A target 250 such as the 10-man squad formation of FIG. 1A is shown in FIGS. 2A and 2B superimposed on the pattern 210.

As can be seen in FIG. 2A, the pattern 210 exhibits petal-shaped asymmetries 212.N extending generally radially from a generally circular core area 215. Because of such asymmetries, the performance of the projectile against a target can vary depending on the orientation of the pattern with respect to the target. FIGS. 2A and 2B show the pattern 210 in two different orientations. For instance, in the first orientation of FIG. 2A, one or more "petals" 212.N of the pattern may fall on multiple silhouettes of the target 250 so that a predetermined incapacitation requirement is met, whereas in a different orientation, such as that of FIG. 2B, the target 250 may fall largely within gaps in the pattern, thereby resulting in a failure to meet the incapacitation requirement.

FIG. 2C shows a second payload dispersion pattern 220 with a more symmetrical shape, but with distinct regions of varying density. Due to the symmetry, the performance of a projectile exhibiting the dispersion pattern of FIG. 2C should be less susceptible to changes in orientation.

A method in accordance with the present invention places the designated target 250 in three-dimensional space and projects the appropriate pattern 210, 220 downrange from the gun, or the point of separation of the payload, to the target. The pattern 210, 220 and how it spreads downrange can be derived from ballistic test data or modeled using theoretical inputs or assumptions. As the pattern is extrapolated downrange, sub-projectile size and velocity are tracked.

When the pattern 210, 220 encounters the target 250, the number of impacts is calculated. In addition, a determination can be made as to whether one or more incapacitation requirements have been met based on the number of impacts and/or sub-projectile velocity. The number of impact and incapacitation determinations can be done at various ranges.

Particularly where the pattern is asymmetric (e.g., FIG. 2A), the pattern can then rotated incrementally, and the number of impacts with the target 250 re-calculated. Satisfaction of the incapacitation requirement can be re-evaluated for each orientation of the pattern. After this process has been repeated and the analysis carried out for a plurality of orientations (e.g., preferably spanning 360 degrees), a variety of results can be determined and displayed in a variety of formats. For example, the percentage of those orientations at which the incapacitation requirement was met can be calculated and displayed for a single shot at a particular range. The process can be repeated for multiple shots and at multiple ranges and the results compared for consistency. A variety of statistics and performance information can be provided in numerical and/or graphical form, as described more fully below.

A general-purpose computer can be programmed to carry out an exemplary analysis method in accordance with the present invention. Such a computer-based system will now be described with reference to FIGS. 3-5.

Figure 3:
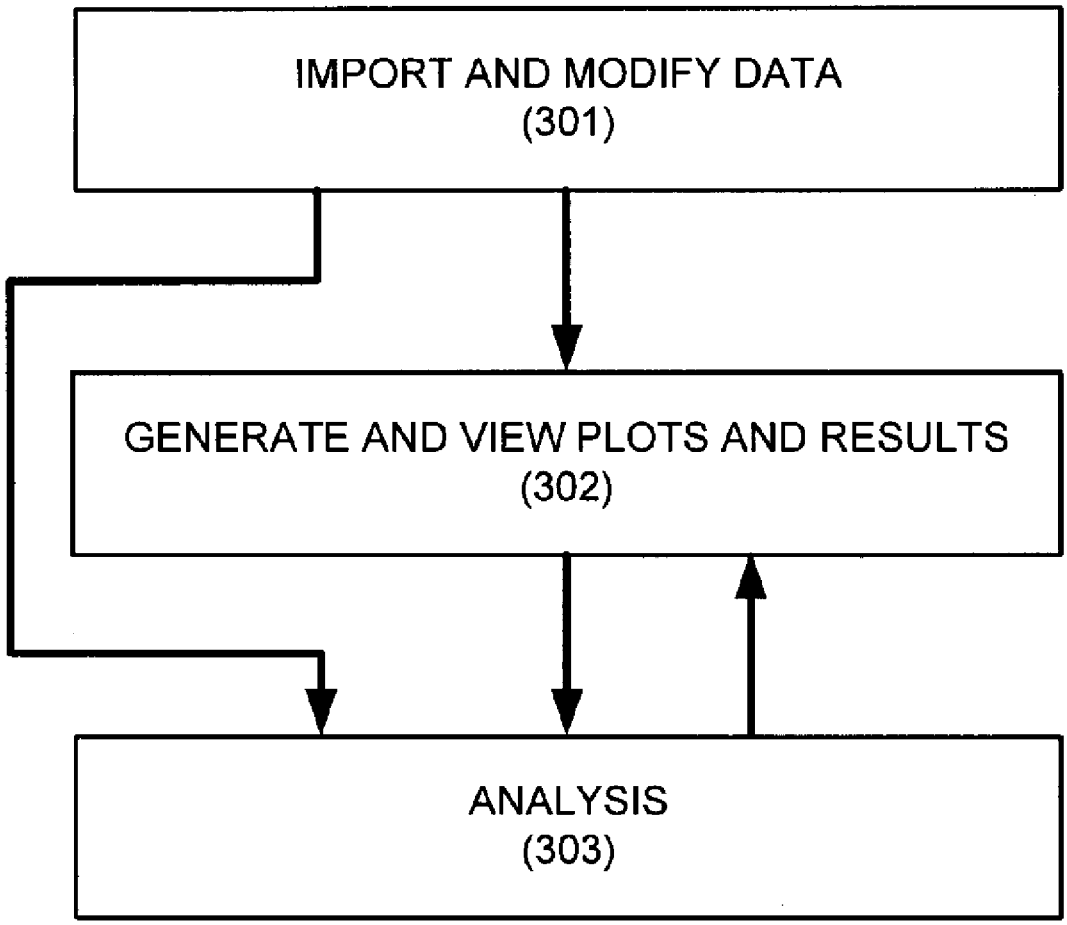
FIG. 3 is a high-level functional block diagram showing three primary modules included in an exemplary system in accordance with the present invention.

FIG. 3 is a high-level functional block diagram showing three primary modules included in the exemplary system, namely, IMPORT AND MODIFY DATA (301), GENERATE AND VIEW PLOTS AND RESULTS (302), and ANALYSIS (303). Each of these modules can be accessed by a user via a graphical user interface (GUI), or the like, to carry out the functions listed for each module.

As shown in FIG. 3, operation may logically start with module 301 to import and modify pattern data and proceed to module 302 where the pattern data can be visualized, or to module 303 where the data is analyzed. Once the analysis has been carried out (303), operation typically proceeds to module 302 to output and view the results. These functions will be described more fully below.

Figure 4:
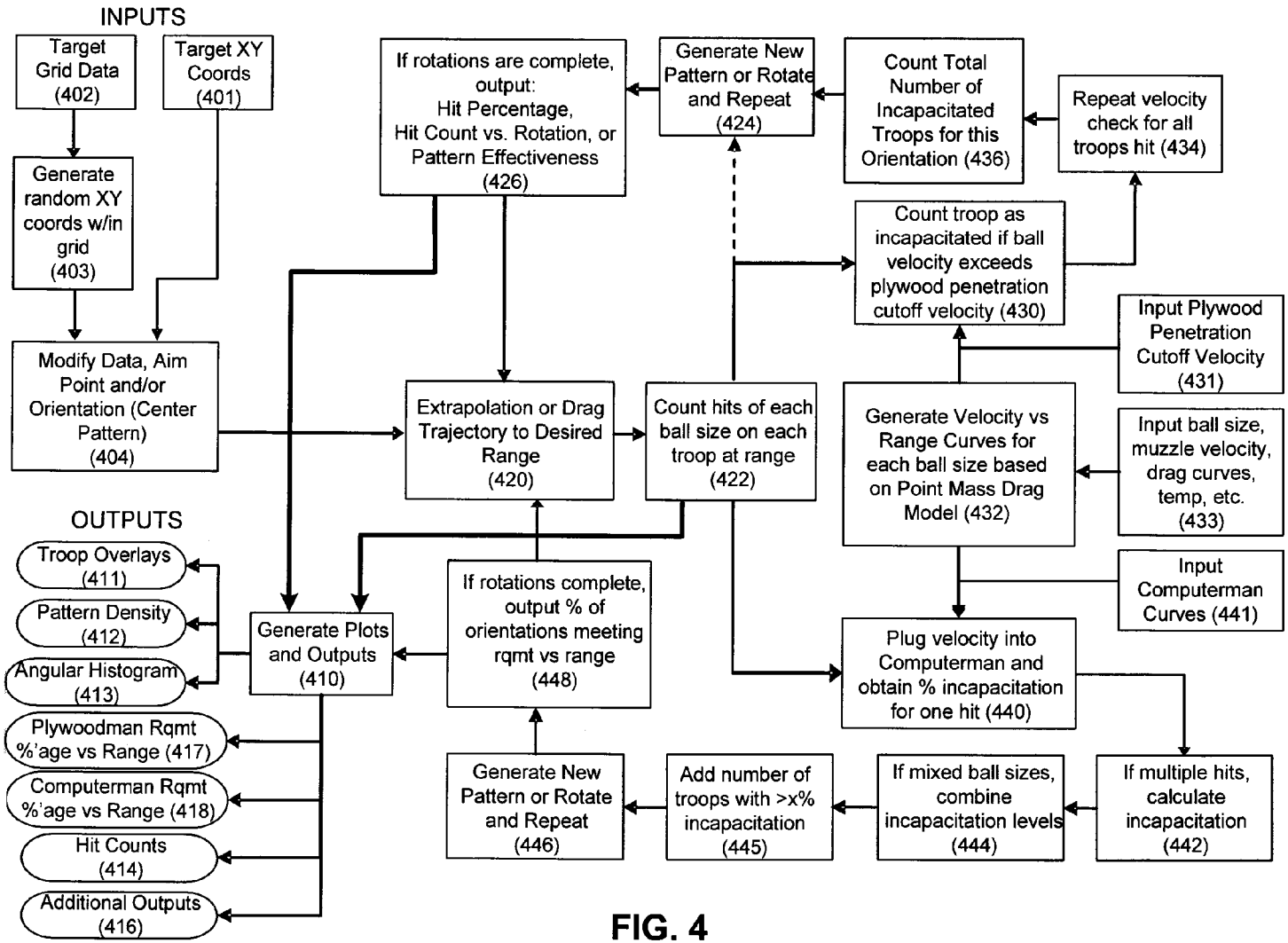
FIG. 4 is a more detailed functional block diagram of the exemplary system of the present invention.

FIG. 4 shows a functional block diagram representation of the exemplary computer-based system of the present invention. The environment is preferably highly flexible and capable of taking various inputs and generating a wide variety of outputs and result formats. The following description highlights some of the primary steps carried out to evaluate performance. The headings below correspond to the primary modules illustrated in FIG. 3.

Import and Modify Data

The primary purpose of the first module 301 is to determine the projectile dispersion pattern that will be used to analyze the performance of the projectile. As mentioned, the pattern can be derived from data collected from actual test firings, computer-generated theoretical data, user-inputted or manipulated data, or a combination thereof.

Data can be imported into the system in a variety of forms, including, for example, in the form of XY coordinates (401) for sub-projectile hits on a test target or grid coordinate data with hit counts indicating the number of sub-projectile hits within each sector of the grid experienced during a test firing (402). In the case of grid data, random XY coordinates can then be generated within each sector of the grid for each hit (403). Ultimately, each dispersion pattern can be represented by a set of XY coordinates, which will typically be based on a specified target range. The pattern data can be represented in other formats as well including, for example, polar coordinates.

Figure 6A:
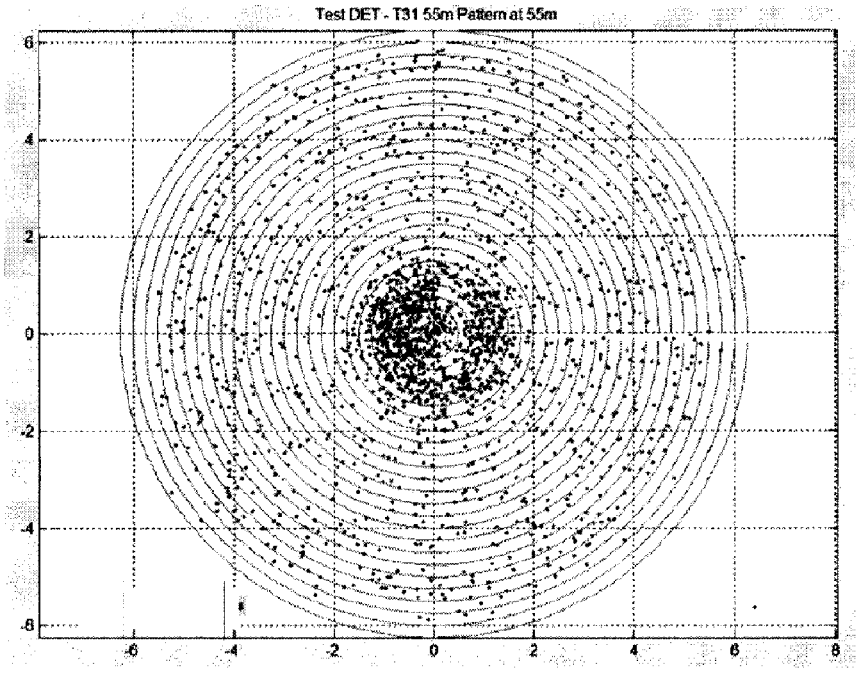
FIG. 6A shows concentric, fixed width ring bins centered about an exemplary payload dispersion pattern
Figure 6B:
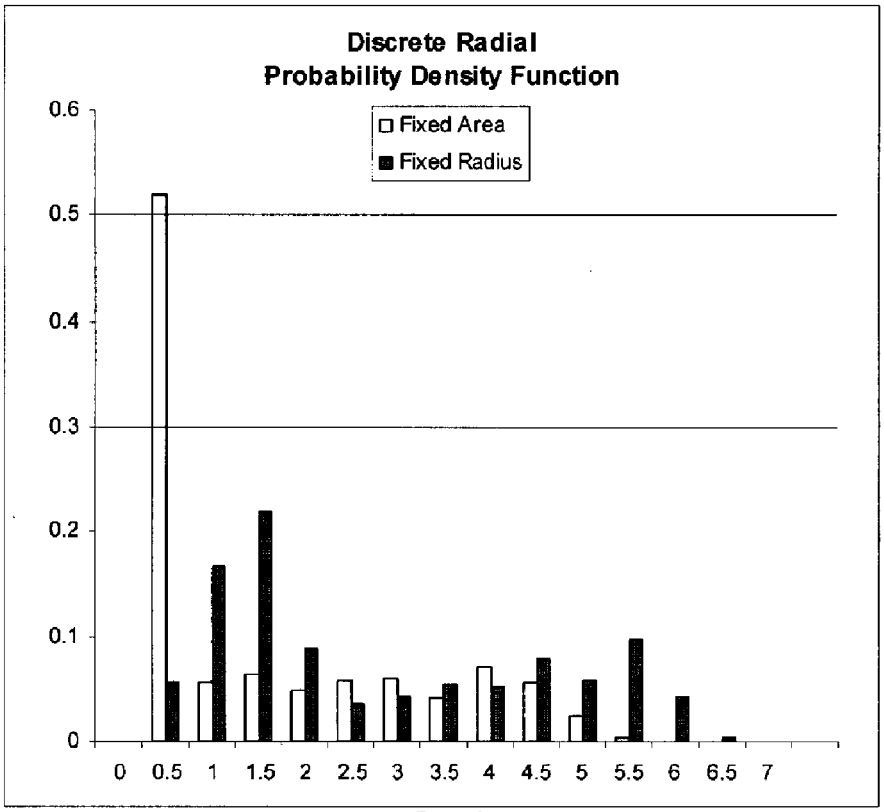
FIG. 6B shows an exemplary probability density function histogram based on the ring bins of FIG. 6A.

Individual patterns or groups of patterns in XY coordinates can also be imported and translated into discrete probability density functions that represent a Poisson distribution for each bin in the histogram. This form can be used for a Monte Carlo analysis mode (described more fully below) to generate random patterns. FIG. 6A shows an exemplary dispersion pattern superimposed on concentric ring-shaped bins of uniform width. In an alternative embodiment (not shown), bins of uniform area can be used instead. FIG. 6B shows exemplary resultant discrete radial probability density functions for fixed area and fixed radius (width) bins, with the horizontal axis representing the radii of the bins from the center of the pattern.

In some cases, the imported test data may be incomplete or have outliers that should be removed. The system preferably includes the capability to remove points, modify the pattern, or replace missing sections caused by test equipment interference.

After the desired pattern is acquired and modified as desired and is ready for performance evaluation analysis, the pattern is centered with respect to the target (i.e., at 0, 0). This can be done using an averaging technique, or the like (404).

Generate and View Plots and Results

Once the data is imported, generated, and/or modified as desired, the system provides a selection of graphics that can be generated for viewing purposes and basic visual analysis (410). The desired pattern can be selected and overlaid on the target of interest at various ranges (411).

A pattern density function (412) is available that analyzes the pattern and creates a color contour plot of the pattern.

An angular histogram function (413) can be selected to break up the pattern into uniform angular sectors or bins (e.g., 20 bins of 18 degrees each) and displays the number of sub-projectiles in each sector. This provides an indication of irregularities or asymmetries in a pattern.

In addition to displaying the pattern and target information that are input into an analysis, various results, metrics, and outputs generated by the analysis can also be displayed in a variety of graphical and/or numeric formats. Such information generated by the analysis will be described more fully below.

The system also preferably allows the user to view results of the analysis for individual increments of rotation of the payload dispersion pattern.

Analysis

Once the relevant projectile dispersion pattern data has been imported, generated and/or modified, as described above, analysis of the performance of the projectile can begin. A linear extrapolation of the pattern data to a desired range or a drag trajectory calculation is carried out (420). Thus, for example, pattern data that was generated from testing at 10 meters, is extrapolated to ranges more typically encountered in actual use, e.g., 100 meters or more. The extrapolated pattern is then projected onto the target.

In an exemplary embodiment, the system of the present invention implements a linear extrapolation method to predict the pattern at various ranges based on the original pattern data. The primary assumption is that the individual payload fragments or sub-projectiles reach their final azimuth and quadrant elevation (QE) angles right at muzzle exit. This assumption will hold true with minimal error for payloads that are dispersed as a result of muzzle action within a short distance outside the gun. The longer the design takes to release all of the sub-projectiles, the less accurate this assumption may be. Assuming the target is at 75 m, for example, if the release occurs 20 m outside the gun it could introduce a 25% error in diameter. In most cases, only a very small percentage of sub-projectiles reach this point before they are completely released. The accuracy could vary depending on the concept and method of payload release. In order to verify the accuracy of the extrapolation, a second target can be used at another range. The patterns can then be matched up and traced back to the gun. In general, the closer the target is to the gun, the higher the probability of error. If it is determined that the extrapolation point is not at the gun, a new extrapolation point beyond the gun can be entered into the system based on experimental data if needed.

In another exemplary embodiment, the drag trajectory can be calculated using the Simulink program (available from The MathWorks, Inc.) as the pattern is extrapolated downrange. The azimuth angle is not affected, only the altitude portion of the trajectory. The drag trajectory uses a linear extrapolation from the target to define the initial quadrant elevation angles at the gun. Given sufficient muzzle velocity and a target close enough to the gun, both trajectories will be almost identical in the early stages.

In projecting the dispersion pattern onto the target, the exemplary system of the present invention assumes that the pattern is aimed correctly and centers the target on the pattern at every range increment (404).

The exemplary system of the present invention provides several options for analyzing the results of the encounter of the target and the projectile payload.

In a first such option, referred to as Hit Count, the target is evaluated at a particular position (e.g., range) and the number of hits on each target silhouette is determined (422). This analysis option provides the quantity of hits that can be expected on a target at the particular position. If multiple sub-projectile sizes are used, the number of hits of each sub-projectile size is tracked. The results can be output in a variety of numerical and/or graphical formats (414).

As discussed, the exemplary target is comprised of a 10-member squad of silhouettes, as shown in FIGS. 1A and 1B. The exemplary squad has five rows of silhouettes, in which case five separate patterns need to be evaluated for each target range. This accurately portrays the fact that the pattern that contacts the silhouettes in the last row will be more widely dispersed than that which encounters the lead silhouette in the squad.

In a second analysis option, referred to as Hit Percentage, a target hit count is determined (422) for each of a plurality of angular orientations of the pattern (424). The angular span of the plurality of orientations and the increments between the orientations can be selected in accordance with the shape of the dispersion pattern. For example, if the pattern has a shape that repeats every 90 degrees, it may not be necessary to perform the analysis over the entire 360 degrees.

After the hit count has been determined for all of the plurality of orientations, the percentage of those orientations in which the target was hit with a minimum number of sub-projectiles or fragments is determined (426). This analysis can be repeated for different target positions (e.g., ranges). The results can be output in a variety of formats (416).

A third analysis option, Hit Count vs. Rotation, is intended primarily to evaluate asymmetrical payload dispersion patterns such as that of FIG. 2A. As described above, a target hit analysis is performed with the dispersion pattern at various angles of rotations (422, 424, 426). For this analysis option, the output may contain a graph displaying the number of targets hit versus the angle of rotation of the pattern. The results provide an understanding of the pattern consistency and how dependent the pattern is on orientation to achieve performance.

In a further analysis option, Pattern Effectiveness, criteria for successful performance are first specified. Such criteria may include, for example, a number of sub-projectile hits over the entire target (e.g., the total number of sub-projectiles landing on all of the silhouettes of the exemplary 10-member squad of FIG. 1A), a distribution of payload hits over the entire target (e.g., the number of silhouettes of the squad hit by a minimum number of sub-projectiles), or the like. The pattern is then evaluated at multiple angular positions and a determination is made of the number of angular positions meeting the aforementioned criteria (422, 424, 426).

The target range is then incremented by a specified distance and the process is repeated. The system outputs, for example, the percentage of rotations that met the selected criteria versus range (410, 416).

A further analysis option, referred to as the Plywoodman Requirement, builds on the Pattern Effectiveness analysis option by tracking sub-projectile size and velocity. The target is evaluated to determine the number of hits sustained by each silhouette of the target, at a particular range, from a single shot (422). The velocity and quantity of sub-projectiles or fragments hitting each target silhouette is then compared to incapacitation criteria to determine if the silhouette has been "incapacitated" (430). A minimum number of sub-projectiles (of a particular size) hitting the silhouette and having a minimum velocity are used as criteria (e.g., 2 small balls of velocity X or 1 large ball of velocity Y). If the criteria are met, the occurrence is deemed to be successful; i.e., the troop represented by the silhouette would be incapacitated (430).

The minimum velocity criteria for a particular sub-projectile size can be selected as that velocity that a sub-projectile of that size must have to penetrate plywood of a given type and thickness; i.e., the plywood penetration cutoff velocity (431), which would be provided as an input to the system of the present invention. By using such criteria, the results generated by the system of the present invention can be compared to those of conventional testing methods using live ammunition and plywood target silhouettes.

In the exemplary system of the present invention, the velocity of the payload sub-projectiles is determined in accordance with a Point Mass Drag Model (432) based on various parameters (e.g., ball size, muzzle velocity, drag curves, temperature, etc.) that are provided as inputs to the system (433).

The payload sub-projectile velocity and incapacitation determinations are repeated for each target silhouette that has been hit (434). The number of incapacitated silhouettes is then counted (436) for the current pattern orientation. The pattern is then rotated and the process repeated (424), as described above, until the rotations have been completed (426). For one possible output, the percentage of rotations for which a predetermined incapacitation requirement (e.g., 50% of silhouettes incapacitated) was met can be calculated. The pattern is then advanced to the next range increment and the process is repeated. The final output (417) may contain, for example, the percentage of rotations meeting the incapacitation requirement at various target ranges.

Another analysis option, the Computerman Requirement, follows the same sequence as the Plywoodman Requirement analysis, however, with different incapacitation criteria. The target is evaluated to determine the number of hits at a particular range (422). The velocity (determined at 432) and quantity of sub-projectiles or fragments is then compared to incapacitation criteria to determine if the occurrence was lethal (440). A series of incapacitation curves are provided as inputs to the system (441). The sub-projectile size determines the curve selected, and the velocity is plugged into the curve to determine the incapacitation. If there are multiple hits, the incapacitation level is calculated accordingly (442). If multiple sub-projectile sizes exist, the overall incapacitation level is determined by combining the incapacitation levels for each sub-projectile size (444).

If multiple hits of one sub-projectile size exist, the following equation is used to calculate the combined incapacitation:

$$E_n=1-(1-E_1)^n \quad \text{(Eq. 1)}$$

If hits of mixed sizes are present, each individual incapacitation is calculated and scaled up and the two different size sub-projectile totals are combined using Equation 2 to get the final incapacitation value:

$$E_T=1-(1-E_{n,A})*(1-E_{n,B}) \quad \text{(Eq. 2)}$$

If the minimum incapacitation criteria are met, the occurrence is counted as successful (445). For example, if a silhouette is deemed more than 50% incapacitated, it is counted as being incapacitated. The pattern is then indexed through the sequence of rotations and the performance is reevaluated (446). At the conclusion of rotations, the percentage of rotations that met the requirement is calculated, the pattern is then advanced to the next range increment and the process is repeated (448). The final output (418) may contain, for example, the percentage of rotations meeting the requirement at various ranges.

The Plywoodman and Computerman analysis models may be readily modified to tailor them to any of a wide variety of projectiles and/or target configurations.

In a further exemplary embodiment of the present invention, a Monte Carlo approach can be taken in place of rotating the pattern. New patterns are generated from discrete probability density functions. These discrete probability density functions represent histograms of test data where each bin is described by a Poisson distribution. This distribution is then used to generate random XY coordinates fitting this density distribution. The new pattern is then evaluated for the above-described performance criteria, and the process is repeated.

Whether the Monte Carlo or rotation method is better suited for a particular analysis may depend on the available data and the pattern type. The Monte Carlo method determines pattern distributions based on a probability density function generated from sample shots. The larger the sample size, the more accurate the simulation. The distribution is then scaled if necessary. Ball counts from the scored targets are not critical nor is the exact pattern alignment on the target due to the high number of iterations. The Monte Carlo method may be the most effective way to determine true statistical performance given a significant sample size to generate the probability density function.

The rotation method determines performance by rotating a single target pattern by a certain number of degrees and repeating to determine a statistical performance. Since the one pattern is used, low ball counts can significantly affect performance results. Hardware interference or holes in the pattern have a more profound effect, and the pattern alignment on the target has a more significant effect. The benefit of the rotation method is that it is an effective means to evaluate single shots or highly asymmetric patterns. Typically, the Monte Carlo method may show slightly better performance results due to the larger number of iterations and larger input sample size.

In a further aspect of the present invention, improvements are provided for carrying out the above-described analyses in a process-efficient manner. The function of counting the number of projectile hits on the target is implicated in each of the analysis options described above. As described above, for the exemplary 10-man squad target of FIGS. 1A and 1B, for each target range, five separate patterns are evaluated corresponding with each troop location. Due to the large number of projectile payload elements and a target consisting of approximately 20 separate regions to scan for hits, the processing of the hit count can take substantial computing time and power.

Figure 5:
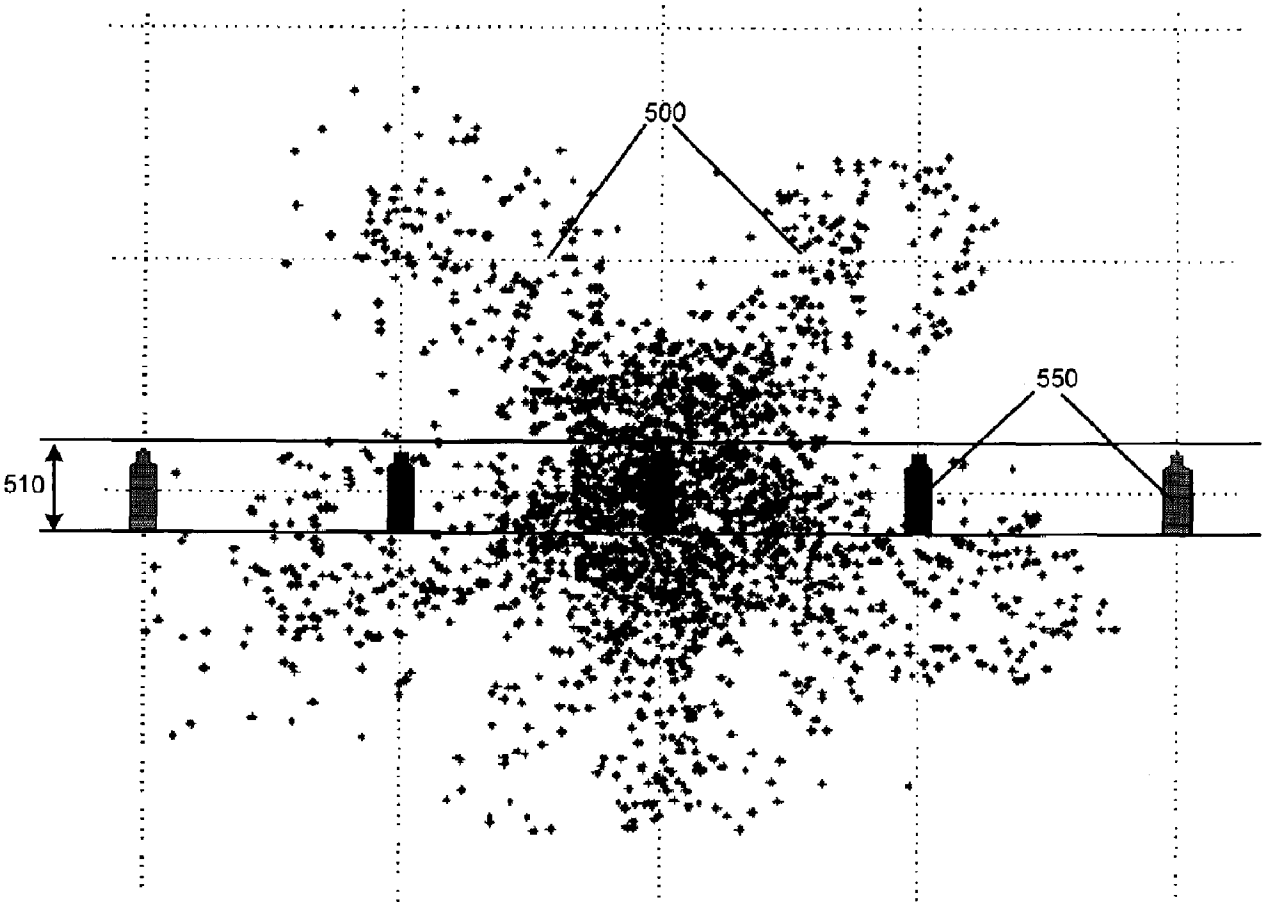
FIG. 5 shows an elevation view of a sub-projectile dispersion pattern superimposed on a target illustrating a filtering technique in accordance with an aspect of the present invention.

In order to reduce the time required to calculate hits, an exemplary embodiment of the system includes a filter. The filter scans all of the payload elements or sub-projectiles in the dispersion pattern being analyzed and focuses only on those elements that have the potential to impact the target. FIG. 5 shows an elevation view of a dispersion pattern 500 with the 10-silhouette target 550 superimposed thereon. In accordance with this aspect of the present invention, the filter selects only those sub-projectiles that fall within a region 510 of the pattern 500. In the embodiment shown, the region 510 is a generally horizontal band that spans across the target 550, covering all 10 silhouettes. In an exemplary embodiment, the bottom boundary of the band may be placed at the horizon (or at some minimum elevation at which incapacitating hits can occur) while the top of the boundary of the band may be placed at or just above the tops of the target silhouettes.

The sub-projectiles selected by the filtering process are then applied to the target silhouettes to determine the hit count. For different pattern orientations, the entire pattern is rotated and the filter re-applied to the rotated pattern to select a new set of sub-projectiles to apply to the target.

The employment of such a filtering process significantly reduces the number of iterations that the hit count process is executed, thereby significantly reducing computer run time. The processing savings are exponential with range, so that whereas at close ranges there is little effect from the filter, at further ranges the filter has a profound effect.

The present invention provides several advantages over previous approaches of evaluating variable patterns and incapacitation calculations. First, the incapacitation determination is made prior to any averaging or percentage calculation. This eliminates the uncertainty due to rounding, described above, often required when using a statistical curve fit process. Second, performance variations based on asymmetries in the payload dispersion patterns, such as shown in FIG. 2A, can be quantified and taken into account in the overall performance evaluation. Third, multiple sub-projectile sizes (or fragment sizes) can be individually tracked and evaluated together on a target. Evaluating a mixed payload simultaneously with statistical methods would be extremely difficult if not impossible in some cases. Fourth, variable density distributions such as that of FIG. 2B can easily be evaluated.

The processing of data and subsequent three-dimensional modeling of pattern performance in accordance with the present invention can also significantly cut down on testing and development costs. For instance, the data required to run an analysis using the present invention can be gathered on smaller cloth targets at close ranges. This eliminates the need to place large "billboard" size targets downrange to capture only portions of the pattern. Since the desired target can be modeled in space, it also reduces the need for full scale testing of physical targets at various ranges. The pattern can be projected downrange into a variety of simulated targets.

The present invention can also be used as an optimization tool to reduce development time and costs. Computer generated theoretical patterns can be created of any size or shape with a desired payload type. The pattern can then be evaluated in the three dimensional model using the rotation method to evaluate performance against the desired target and incapacitation criteria.

It is understood that the above-described embodiments are illustrative of only a few of the possible specific embodiments which can represent applications of the invention. Numerous and varied other arrangements can be made by those skilled in the art without departing from the spirit and scope of the invention. Accordingly, the present invention is to be limited only by the scope of the claims attached hereto.

What is claimed is:

1. A method for analyzing the performance of a projectile comprising a plurality of sub-projectiles, the method comprising:

determining a dispersion pattern of the plurality of sub-projectiles;

extrapolating the dispersion pattern to a range of a target;

projecting the sub-projectiles onto the target in accordance with the extrapolated dispersion pattern; and determining a number of sub-projectiles hitting the target.

2. The method of claim 1, wherein determining the dispersion pattern includes inputting data from a test using an actual projectile.

3. The method of claim 1, wherein the step of extrapolating includes calculating a drag trajectory.

4. The method of claim 1, wherein the plurality of sub-projectiles include sub-projectiles of at least two sizes.

5. The method of claim 1, comprising rotating the dispersion pattern before projecting the sub-projectiles onto the target.

6. The method of claim 1, wherein determining a dispersion pattern includes generating a random dispersion pattern from discrete probability density functions obtained from test data.

7. The method of claim 1, comprising determining an incapacitation of the target.

8. The method of claim 7, wherein the target includes a plurality of target elements and the target is determined to be incapacitated if a number of the target elements are determined to be incapacitated.

9. The method of claim 1, wherein the target includes a plurality of target elements, the method comprising determining an incapacitation of at least one of the target elements.

10. The method of claim 9, wherein a velocity of each of the sub-projectiles hitting a target element is determined.

11. The method of claim 10, wherein the target element is determined to be incapacitated if the velocity of a sub-projectile hitting the target element exceeds a penetration cutoff velocity.

12. The method of claim 10, wherein an incapacitation level of the target element is determined in accordance with the velocity of a sub-projectile hitting the target element.

13. The method of claim 10, wherein the velocity of each of the sub-projectiles is determined in accordance with a point mass drag model.

14. The method of claim 1, comprising filtering the dispersion pattern before projecting the sub-projectiles onto the target.

15. The method of claim 14, wherein filtering the dispersion pattern includes selecting sub-projectiles within a region of the dispersion pattern, the region including at least a portion of the target.

16. The method of claim 15, wherein the region includes a generally horizontal band.

* * * * *